US006279718B1

(12) United States Patent
Nulph et al.

(10) Patent No.: US 6,279,718 B1
(45) Date of Patent: Aug. 28, 2001

(54) MERCHANDISING MACHINE WITH BULK COIN HOPPER

(75) Inventors: Michael R. Nulph, Cedar Springs; Donald A. Dekker, Grand Rapids; Jeffrey J. Kalis, Rockford; James D. Collins, Jenison, all of MI (US)

(73) Assignee: Rowe International, Inc., Grand Rapids, MI (US)

( * ) Notice: Subject to any disclaimer, the term of this patent is extended or adjusted under 35 U.S.C. 154(b) by 0 days.

(21) Appl. No.: 09/436,775

(22) Filed: Nov. 8, 1999

Related U.S. Application Data

(60) Provisional application No. 60/107,795, filed on Nov. 10, 1998.

(51) Int. Cl.[7] ..... G07F 7/04; G07D 9/00; G07D 1/00

(52) U.S. Cl. ..... 194/206; 453/17; 453/57

(58) Field of Search ..... 194/206, 207; 453/17, 57

(56) References Cited

U.S. PATENT DOCUMENTS

| | | | | |
|---|---|---|---|---|
| 3,173,431 | | 3/1965 | Chichester et al. . | |
| 3,590,833 | | 7/1971 | Walton | 133/2 |
| 3,680,566 | | 8/1972 | Tanaka et al. | 133/3 |
| 3,752,168 | | 8/1973 | Bayha | 453/17 |
| 3,910,295 | | 10/1975 | Fletcher | 133/8 |
| 3,952,915 | | 4/1976 | Pitel et al. | 221/75 |
| 3,971,393 | * | 7/1976 | Akai et al. | 194/206 |
| 4,284,184 | | 8/1981 | Hoffman | 194/2 |
| 4,541,444 | * | 9/1985 | Okada | 194/206 |
| 5,067,928 | | 11/1991 | Harris | 453/17 |
| 5,113,990 | | 5/1992 | Gabrius et al. | 194/206 |
| 5,167,571 | | 12/1992 | Waller | 453/29 |
| 5,181,882 | | 1/1993 | Miyazawa | 453/63 |
| 5,190,495 | | 3/1993 | Taxon | 453/32 |
| 5,295,900 | | 3/1994 | Tsuchida et al. | 453/57 |
| 5,366,407 | | 11/1994 | Sentoku | 453/3 |
| 5,386,903 | | 2/1995 | Rothschild et al. | 194/350 |
| 5,467,857 | | 11/1995 | Takemoto | 194/206 |
| 5,688,165 | * | 11/1997 | Levasseur | 453/17 |

* cited by examiner

*Primary Examiner*—Robert P. Olszewski
*Assistant Examiner*—Bryan Jaketic
(74) *Attorney, Agent, or Firm*—Van Dyke, Gardner, Linn & Burkhart, LLP

(57) ABSTRACT

A vending or merchandising machine is provided which includes a bulk-loaded coin hopper for providing change to a user of the machine. The vending machine may be operable in a change mode, wherein change is dispensed from the bulk loaded hopper in an amount equivalent to the amount of credit input into the machine by user, or a vending mode, where a user may select an item to be purchased, and receive the item and change in an amount equal to the input amount less the purchase price of the item. Preferably, the vending machine automatically switches to the change mode in response to an input threshold amount being inserted into the vending machine. Preferably, the vending machine further may be selectively switched to the change mode in response to a user input on a keypad or the like on the merchandising machine.

111 Claims, 5 Drawing Sheets

MERCHANDISING MACHINE WITH BULK COIN HOPPER

This non-provisional application claims priority from U.S. Provisional Patent Application, Ser. No. 60/107,795, filed Nov. 10, 1998, which is hereby incorporated herein by reference.

BACKGROUND OF THE INVENTION

This invention relates generally to a merchandising machine for dispensing a particular item when an appropriate amount of money is deposited therein and, more particularly, to a merchandising machine that may receive large denominations of bills.

Electronically operated vending or merchandising machines for dispensing various articles at various prices are known in the art. In a typical vending machine, a coin mechanism and/or bill acceptor communicate with a control which permits delivery of a particular item when a sum of money totaling at least the purchase price of that item has been accepted by the bill acceptor and/or the coin mechanism. It is generally desirable that in addition to providing the item to a purchaser upon deposit of money into the machine, the vending machine also provides change for the amount that the purchaser deposited into the machine in excess of the purchase price of the item. In order to provide change, additional coins holders are required within the vending machine to keep the appropriate coins such that the exact change may be returned to the consumer upon purchase of the desired item.

A user of a conventional vending machine may input a dollar bill and press the coin return lever and get change, depending on how the machine is set up. Sometimes a machine returns the dollar bill, and sometimes it takes the bill and stacks it immediately into a secure bill box and, if the user presses a coin return lever, the user receives change instead of the bill. However, the machine will pay change out of the coin holders, which is problematic in that it depletes the coin holders, making the machine quickly enter an "exact change only" mode of operation. This is undesirable from an operator's standpoint, since operators do not want to turn away potential customers simply because the machines are without the correct change.

Typically, the coin holders in coin mechanisms used in vending machines are cylindrical tubes integral to the coin mechanism, which is mounted on an interior side of the service door of the vending machine. A number of these tubes may be positioned side-by-side of one another, each one dispensing a different coin so as to provide the exact change. For example, one cylinder may dispense nickels, while another dispenses dimes, quarters, or the like. While such a system is capable of providing the exact change to a consumer, the small size of the coin-holding cylinders may limit the items to be sold within the vending machine to small inexpensive items, and further may lead to the vending machine requiring service more often, as the supply of coins within the coin holders become depleted.

A typical coin-holder is compact so as to fit along the front panel of the service door, and typically holds a rather small volume of coins therein. For example, a coin holder for quarters may hold only 80 quarters within the coin holding cylinder. Therefore, the vending machine must be serviced on a regular basis to prevent the coin supply from being depleted. While depletion of the coin supply may not result in the vending machine being completely disabled, it does lead to an "exact change only" display being activated, as the vending machine is no longer capable of providing exact change back to the consumer. Activation of the "exact change only" light is very undesirable, as most consumers carry with them a number of one or five dollar bills or the like, but do not typically carry exact change to cover, for example, an 85 cent item. The result potentially being a loss of sale to the vending machine owner.

Furthermore, because of the small size of the coin holders of a typical vending machine, bill acceptors provided with such vending machines are typically limited to be able to accept only one dollar bills and maybe five dollar bills therein, as larger denominations of bills would substantially deplete the coin supply in the coin holders. Such a restriction on the denomination of bills that may be accepted within the machine may limit the machine to be only able to sell inexpensive items that may be purchased by a five dollar bill or less. Also, by not allowing a consumer to deposit a larger denomination of bills, the vending machine may lose additional sales when a consumer only has, for example, a ten dollar bill or greater available at the time they wish to purchase an item from the vending machine.

An additional concern with conventional vending machines is that they generally may only be used to dispense items and not change alone when the appropriate amount of coins or dollar bills are inserted therein. If a consumer needs additional coins for purchasing additional items, or for use in a different machine, such as a coin operated laundry machine or a gaming machine or the like, a separate bill changing machine may be required that contains a bulk hopper full of a single type of coin. These changing machines may accept larger denomination bills, and may provide large quantities of change to the user of the machine. However, while a changing machine may hold substantially more coins than a typical vending machine, so as to avoid depleting the supply of coins as quickly, an owner of a vending machine generally does not want to purchase a separate changing machine to locate in an area where the vending machine is already present. Not only may the cost to purchase the additional changing machine be prohibitive of providing the machine by a vending machine, but space constraints at the desired location of the vending machine may also prohibit placing an additional changing machine in the vicinity of the vending machine.

SUMMARY OF THE INVENTION

The present invention is intended to provide a coin dispensing device for use in the vending or merchandising machine which is capable of providing large quantities of change to a consumer upon receipt of money or tokens deposited therein.

According to a first aspect of the invention, a merchandising machine comprises a merchandise dispensing assembly and a coin dispensing assembly, which includes at least one container for holding a supply of coins in bulk. A control circuit is also provided for determining an amount of money or tokens inserted into the merchandising machine and further determining a return amount to the consumer. The return amount is usually change resulting from the difference between an inserted amount of money and the purchase price of the selected item. Occasionally, the return amount is the entire amount or value of the money that has been inserted by the consumer. In either case, the return amount is frequently dispensed from the container for holding a supply of coins in bulk.

In one form, the control circuit may provide change from the container for holding a supply of coins in bulk if the amount inserted into the vending machine is greater than a predetermined threshold amount. In another form, the user of the vending machine may select between a purchase mode and a change mode, such that in the purchase mode, coins are returned from a plurality of coin retaining tubes and the bulk container, while in the change mode, coins are returned from the bulk container.

DESCRIPTION OF THE PREFERRED EMBODIMENTS

Figure 1:
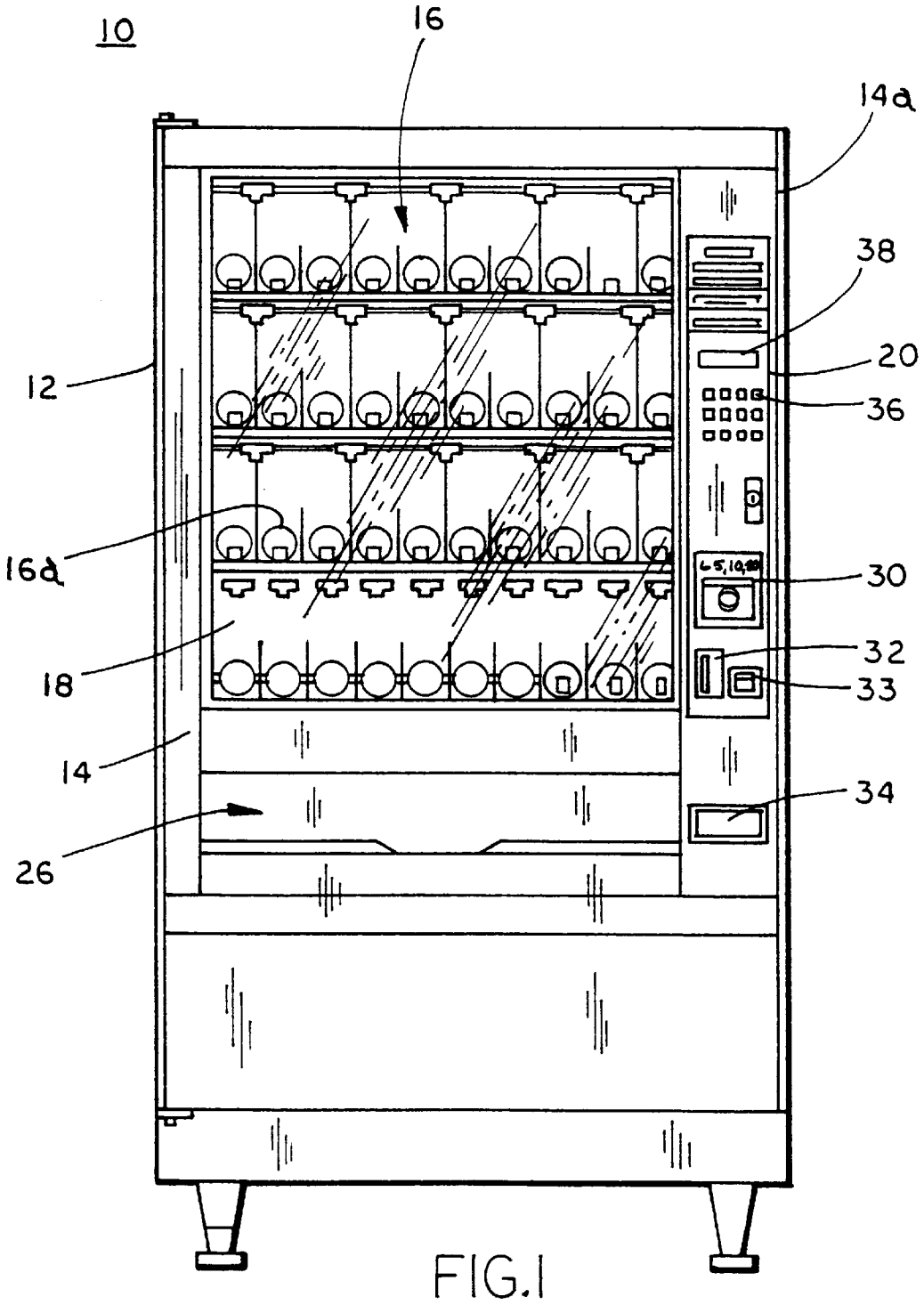
FIG. 1 is a front view of a merchandising machine according to the present invention.

Referring now to the figures and the illustrative embodiments depicted therein, there is shown in FIG. 1 a vending or merchandising machine 10, which comprises a cabinet 12 and a service door 14, which encase a product vending area 16. The service door 14 further comprises a viewing window or transparent panel 18, which allows a user of the vending machine to view the items within the product vending area 16, and a user control panel 20, which a user of the vending machine 10 may interface with to deposit money or other credits into the machine and select an item from the product vending area 16 or receive change in an amount substantially equivalent to the credits deposited therein. Vending machine 10 of the present invention further includes a bulk coin holder or hopper 22 (FIG. 2), which may hold a large quantity of a single denomination of coins or tokens therein. By providing a bulk loaded hopper 22, the vending machine of the present invention may function to provide change in response to a receipt of a higher denominational bill over conventional vending machines.

Preferably, the cabinet 12 product dispensing or delivery unit of vending area 16 and a power supply and distribution center 24 of merchandising machine 10 are substantially similar to those of conventional vending machines. An example of a delivery unit for a merchandising machine is disclosed in U.S. Pat. No. 3,952,915, issued Apr. 27, 1976 to Pitel et al., the disclosure of which is hereby incorporated herein by reference. The product vending area 16 comprises shelves or levels with multiple dispensing devices, such as coils 16*a,* carousels, such as horizontally rotating carousels with individual doors, ferris wheel devices, which present the items at a door, or shelves with individual doors, or the like. The dispensing devices may rotate, open or otherwise move to dispense the selected item to the consumer in response to signals from a main control 40 (FIG. 3) of merchandising machine 10. The item may then drop down to a delivery area 26 or may be otherwise provided to a door or other opening (not shown) as is known in the art of vending machines. The present invention may be applied to snack vending machines, refrigerated or non-refrigerated food vending machines, beverage vending machines, or other vending machines, gaming machines or the like. Clearly, the present invention may be implemented with other machines which may provide a particular function in addition to a changing function, without affecting the scope of the present invention.

User panel 20 is preferably located along one side 14*a* of service door 14 and substantially adjacent to the window 18 for viewing the vending area 16. The user panel 20 preferably comprises a bill receiving slot 30 for insertion of a dollar bill or other denomination of bill into a bill acceptor 31 (FIG. 3), a coin slot 32 for receiving coins into a coin receiver 42 (FIG. 3), and a coin return opening or cup 34 which collects change for the user of the machine. A coin return lever or button 33 is provided so that a consumer may cancel a transaction in progress and receive his or her inserted monies back. A keypad 36 is also provided along a front face of the user panel 20. A user or consumer may then key in their selection, which is typically accomplished by selecting alphanumeric symbols on the keys which correspond to locations along the shelves or levels of the vending machine which contain or hold a particular product. User panel 20 may further include a display 38, which displays the status of the machine (such as "insert coins," "exact change only," and the like) and/or may display the total credit entered and/or may verify the selection entered by the user or consumer at merchandising machine 10.

Figure 2:
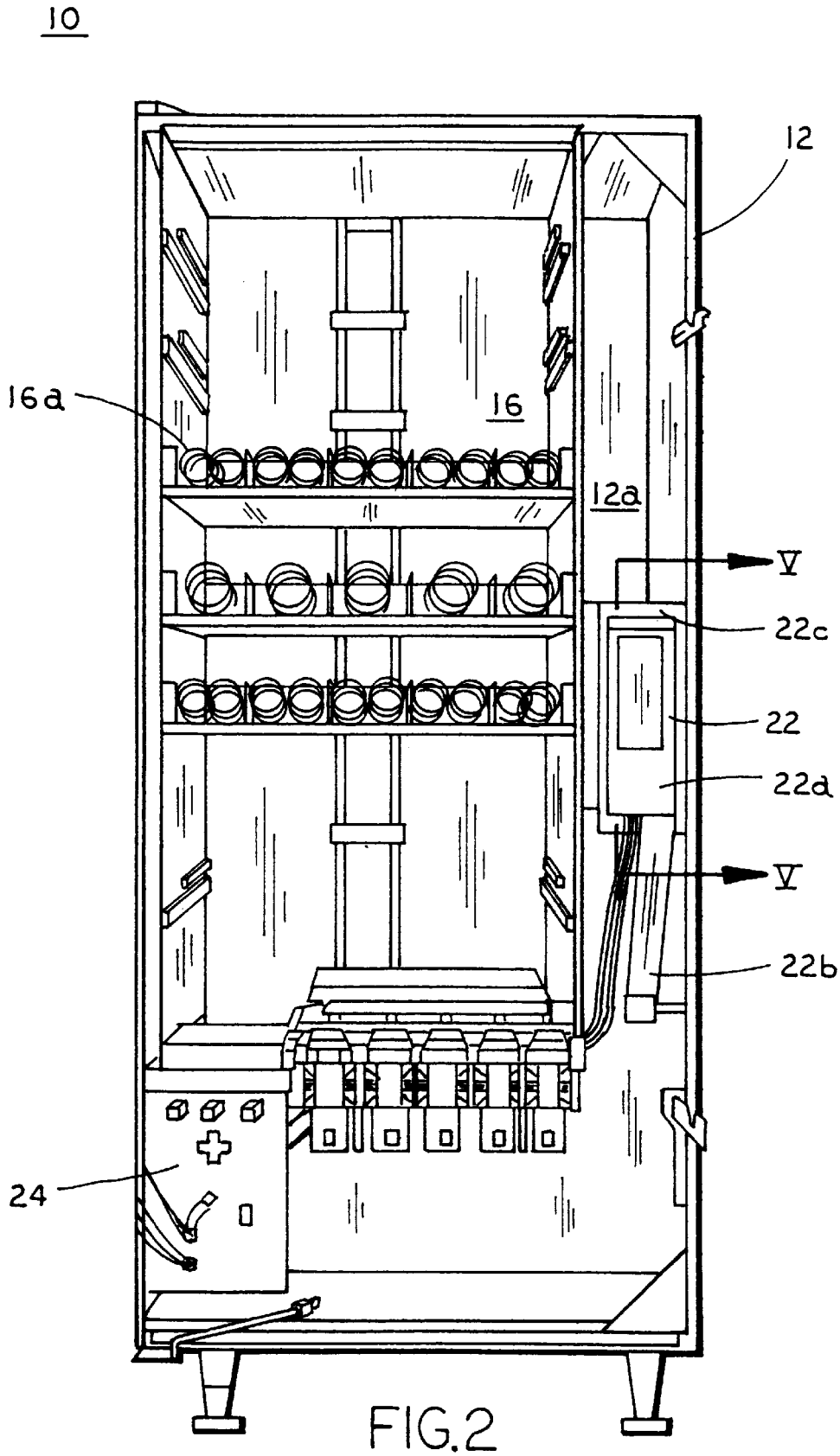
FIG. 2 is a front view of the merchandising machine of FIG. 1, with the service door removed therefrom.

As shown in FIG. 2, bulk coin hopper 22 is preferably positioned within merchandising machine 10 and immediately rearward of user panel 20 when service door 14 is closed. The preferred location for bulk hopper 22 is within a typically unused space 12*a* of a conventional vending machine cabinet, such that the bulk coin dispenser may be implemented in a conventional cabinet without interfering with the vending area or otherwise increasing the size of the vending machine. This space is located adjacent to the viewing and dispensing area 16 and is typically vacant, since the space was originally designed for packaging electronics and power supplies, which have become much smaller over the years such that there is the substantial amount of space rearward of the control panels of the vending machines. Although bulk coin hopper 22 is shown in the vacant area 12*a* rearward of the control panel, a bulk coin hopper may be implemented in other areas of merchandising machines without affecting the scope of the present invention.

Figure 3:
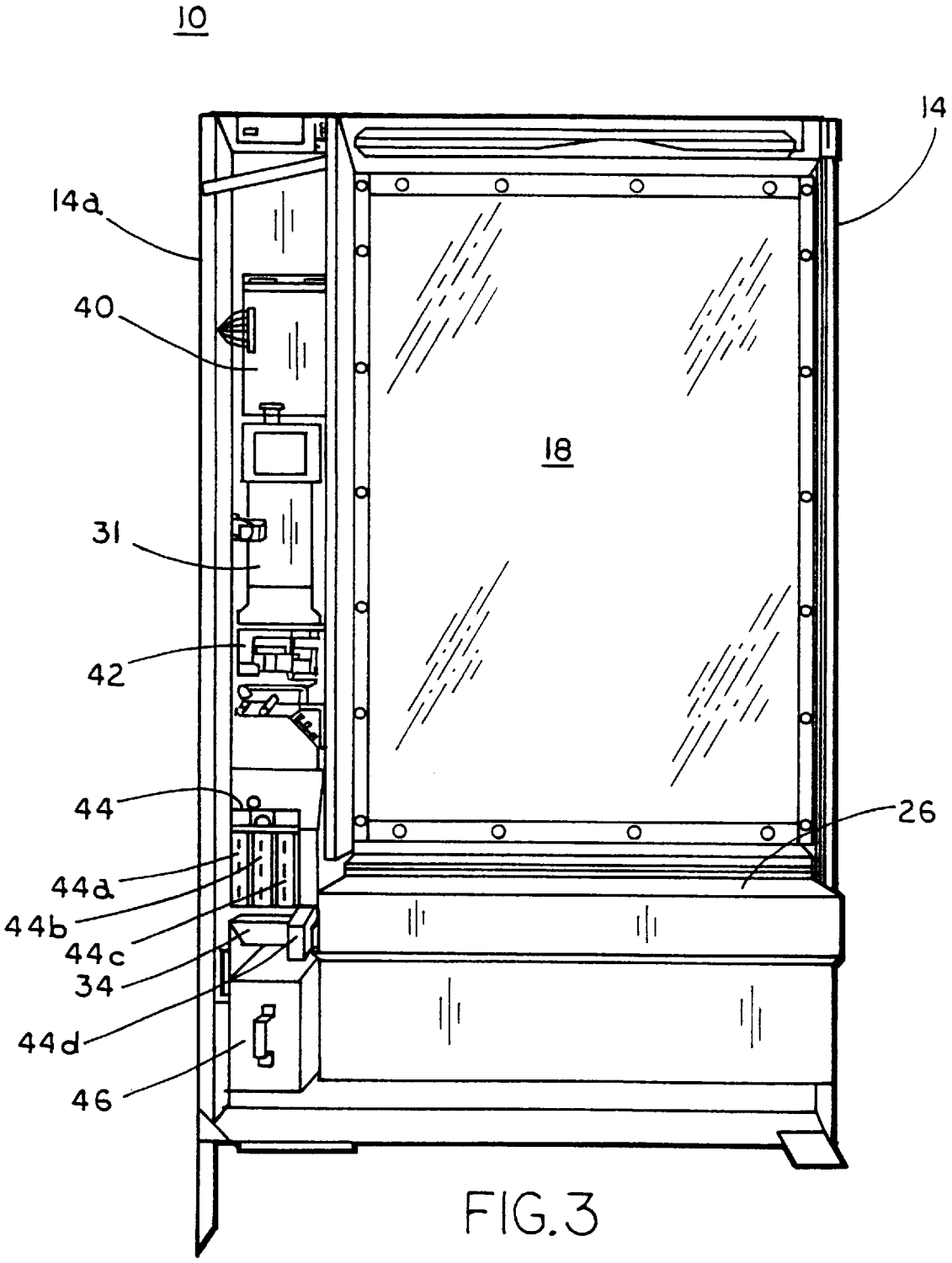
FIG. 3 is a rear view of the service door of the merchandising machine of FIG. 1.
Figure 5:
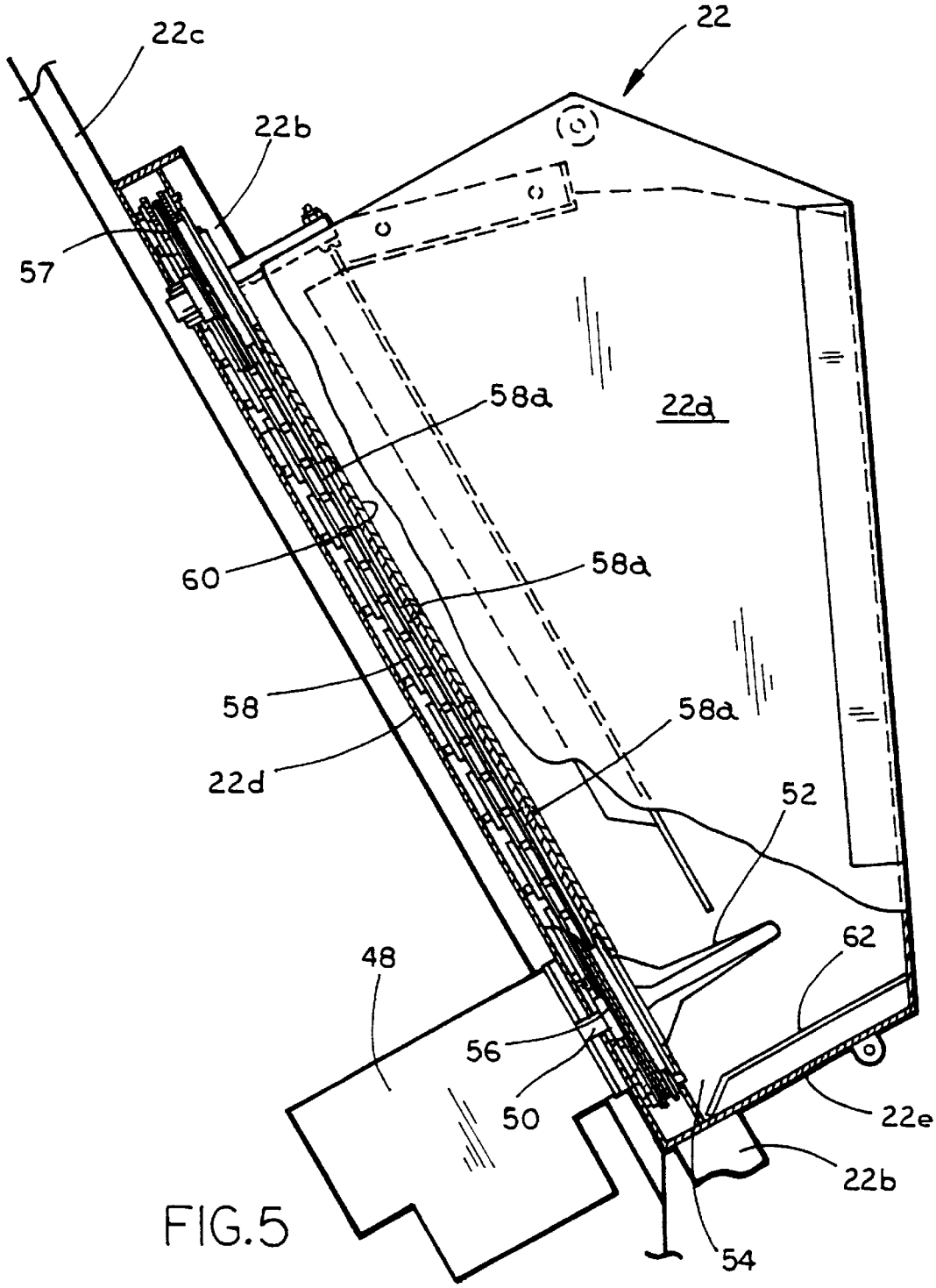
FIG. 5 is a sectional view of a bulk hopper useful with the present invention taken along the line V—V in FIG. 2.

The bulk coin hopper 22 comprises a coin container 22*a* and a coin chute 22*b,* through which the coins or tokens travel as they are dispensed from the bulk hopper 22 to the coin cup 34 (FIGS. 1 and 3). The bulk hopper 22 of the present invention further comprises a circuit board (not shown) for interfacing with the controls and electronics of the merchandising machine 10, as discussed below. As shown in FIG. 5, hopper 22 further comprises a motor 48, which is operable to drive a chain 58 in response to an input to its control circuit. Motor 48 is operable to rotate a shaft 50, which has an agitator 52 secured thereon. Rotation of agitator 52 functions to expedite the downward travel of the coins within the storage area 22*a* to a coin pick up region 54. A chain drive sprocket wheel 56 is also secured to shaft 50 and engages a continuous chain 58, which is movable about drive wheel 56 and an idler sprocket 57. The chain extends between drive wheel 56 and idler sprocket 57 along and between a rearward wall 22*d* and a coin ramp 60. Chain 58 includes a plurality of pins 58*a,* which extend through a slot (not shown) in the coin ramp 60 a distance less than the thickness of the coin denomination to be provided by hopper 22.

When motor 48 is activated, agitator 52 moves the coins within a lower region of hopper 22 to prevent jamming of coins. The coins travel downward along a guide 62 positioned along a lower wall 22*e* of hopper 22. Guide 62 is preferably bent toward its lower end adjacent to pick up area 54, which causes the coins to lie flat as they move downward into pick up area 54. Pins 58*a* of chain 58 thus may readily engage the coins in the coin pickup region 54 and guide the coins up coin ramp 60. A guide plate (not shown) along coin ramp 60 confines the coins between the plate and the side wall of hopper 22 as the coins are moved upwardly along coin ramp 60, such that the coins are moved to the top of the hopper where they are counted. The coins are counted as they pass by a photocell, sensor, or the like (not shown) which detects the coins as they travel toward coin chute 22*b*. The coins are then dropped from the hopper and travel down the coin chute 22*b* and into the coin return bin or cup 34 on the service door 14. When the specified number of coins being dropped from the hopper is reached, the motor is deactivated. The circuit board on the bulk hopper communicates with the control of the vending machine 10, such that the appropriate amount of coins are dispensed from hopper 22 according to the amount of credits that are deposited into the vending machine 10 and further according to the function that vending machine 10 is to provide to the consumer in that particular transaction, as discussed below. Preferably, the bulk loaded coin hopper 22 is a conventional bulk hopper, of the type used in a "Century Six" change dispenser, which is commercially available and marketed by Rowe International, Inc., located in Grand Rapids, Mich. An example of a bulk loaded coin hopper is also disclosed in U.S. Pat. No. 3,910,295, issued Oct. 7, 1975 to Fletcher, which is hereby incorporated herein by reference.

Bulk hopper 22 is placed within the vending machine cabinet, and preferably is removably mounted to a mounting base 22*c* secured behind the service door to ease servicing on site and to further ease loading and unloading coins from the hopper 22. Preferably, the hopper further comprises a spring loaded latch (not shown) which latches the hopper in place for operation. The latch may be easily released to pivot the hopper outwardly for loading purposes such that the operator does not have to remove the hopper from the machine. The hopper 22 may be further released to be removed from the machine if necessary, either for servicing, refilling or replacement of the hopper. Once loaded with coins, the hopper may be pivoted back into its operating position, as shown in FIG. 2, and latched to mounting base 22*c*.

Bulk loaded hopper 22 may contain a large quantity of quarters, dimes, nickels or any other coins or tokens as desired, and may be adaptable or foreign currency as well. Preferably, the hopper 22 may hold up to at least approximately 2,000 quarters, although a larger or smaller hopper may be implemented without affecting the scope of the present invention. More preferably, bulk hopper 22 may hold up to approximately 3,200 quarters. By providing a bulk loaded hopper 22 which holds such a large quantity of coins, the vending machine 10 may accept higher denomination of bills within bill acceptor 31. It is further envisioned that merchandising machine 10 may comprise two or more bulk hoppers, as discussed below.

Referring now to FIG. 3, service door 14 further comprises a control 40, bill acceptor 31, a coin insert and return assembly or coin acceptor 42, a coin holder or coin mechanism 44, and a coin or cash box 46. Preferably, coin insert and return assembly 42 and bill acceptor 31 are conventional coin and bill acceptors for receiving and identifying coins and bills therein, respectively. Preferably, however, bill acceptor 31 may accept bills of a range including a higher denomination than a conventional vending machine bill acceptor. For example, rather than having a conventional vending machine bill acceptor which only accepts one and five U.S. dollar bills and maybe even a two U.S. dollar bill, bulk hopper 22 of merchandising machine 10 facilitates implementation of a bill acceptor 31 which may further accept ten and twenty U.S. dollar bills, without substantially depleting the supply of coins within the vending machine. Furthermore, bill acceptor 31 is preferably operable to receive and stack or contain a larger number of bills than a conventional vending machine bill acceptor, so as to avoid having to empty the bill acceptor as often as with conventional vending machines. For example, bill acceptor preferably may accept and contain up to approximately 1,000 bills before it is filled, versus a conventional vending machine bill acceptor which may only receive and contain up to approximately 500 bills.

Coin mechanism 44 is preferably a conventional coin mechanism, which comprises a plurality of conventional coin holders 44*a,* 44*b,* and 44*c*. Preferably, each cylindrical coin holder 44*a,* 44*b,* and 44*c* may contain one of nickels, dime and quarters. However, the coin holders may contain other coins or tokens as desired without affecting the scope of the present invention. Coin mechanism 44 is preferably mounted along the interior surface of service door 14, and above the coin return cup 34. Due to the space constraints along interior door 14 between an outer edge 14*a* and transparent panel 18, coin mechanism 44 generally holds a substantially smaller supply of coins than a bulk loaded hopper. For example, the conventional cylindrical coin holder of a conventional coin mechanism may hold up to approximately 80 quarters, and a similar quantity of nickels, dimes or the like. Accordingly, the supply of coins in coin mechanism 44 may be rapidly depleted if merchandising machine 10 provides change for users which insert a large denomination bill for a low cost item or for change only.

Coins which are inserted through coin slot 32 are received by a conventional coin insert and return assembly 42 and further received by coin mechanism 44. If the coin cylinder 44*a,* 44*b* or 44*c* is capable of holding more coins of the type which is deposited through slot 32, then the coins may be retained by coin mechanism 44, thereby at least partially replenishing the supply in one or more of the coin cylinders 44*a,* 44*b,* and 44*c*. However, if the coin cylinder corresponding to the coins deposited through slot 32 is already full at that time, the coins pass through coin mechanism 44 through a coin chute 44*d* and into cash box 46, where they remain until cash box 46 is emptied or replaced, as is known in the art. Alternatively, if the inserted coins are not acceptable by the coin acceptor 42, the coins are dropped down to the coin cup 34 via a return chute (not shown), as is known in the art.

Because bill acceptor 31 of vending machine 10 may accept large denomination bills, such as ten dollar bills and twenty dollar bills, which vending machine 10 may provide change for, coin return cup 34 is preferably much larger than a conventional coin return cup on a conventional vending machine. Preferably, coin return cup 34 is capable of holding up to 80 quarters, such that change may be provided for a twenty dollar bill from bulk hopper 22. Furthermore, because vending machine 10 may be operable for a longer period of time over conventional vending machines, cash box 46 may also be of a greater size than a conventional cash box, such that cash box 46 may receive more coins or tokens before it becomes filled.

Vending machine control 40 may also be positioned along an interior surface of service door 12, as shown in FIG. 3. However, control 40 may be positioned elsewhere in merchandising machine 10 without affecting the scope of the present invention. Control 40 is electronically connected to bill acceptor 31, coin acceptor 42, bulk hopper 22, keypad 36, display 38 and power supply and distribution center 24. Control 40 receives a signal from either or both bill acceptor 31 and coin acceptor 42 which conveys to control 40 the amount of credit, such as dollar bills or coins or tokens, that has been received by bill acceptor 31 and/or coin acceptor 42. Preferably, control 40 may include conventional vending machine software and further include software from a gaming coin changer, and thus serve as an interface between the bulk hopper coin changer and the merchandising machine itself. An example of an interface between a coin mechanism and merchandising machine is disclosed in commonly assigned U.S. Pat. No. 4,284,184, issued Aug. 18, 1981 to Hoffman, which is hereby incorporated herein by reference. Preferably, control 40 may switch from a conventional vending mode to a changing mode in response to either the amount of credits deposited into vending machine 10 or an input keyed into the keypad 36 by a user, or both. Control 40 then is operable to provide signals to move or otherwise cause the item dispensers 16*a* of the vending machine to dispense the selected item, or to provide change to the user from coin mechanism 44 and/or bulk hopper 22, or both. Preferably, change would be provided to the user from bulk hopper 22, if possible, before any change is provided from coin mechanism 44, in order to delay depletion of the coin supply within coin mechanism 44 for as long as possible.

Preferably, control 40 automatically switches to a changing mode when the amount of money received by bill acceptor 31 is above a predetermined automatic change threshold level. For example, if a user inserts a ten or twenty dollar bill into bill acceptor 31, control 40 may automatically switch to a changing mode, whereby control 40 may communicate with the control circuit of bulk hopper 22 such that change is provided in an amount substantially equivalent to the money received by bill acceptor 31 from bulk hopper 22. The threshold denomination amount for the automatic changing function may be a preset limit which may be set by an operator or manager of vending machine 10 in the setup menu system of the vending machine. If an amount of money is inserted into bill acceptor 31 and/or coin acceptor 42 which is below the threshold amount, control 40 may function in a vending mode, such that the user may select and purchase an item from within the vending machine. Preferably, change in the amount of excess of the purchase price of the item is then provided to the user from the bulk hopper unit 22 and may be further provided from the conventional coin mechanism 44, if the supply of coins in bulk hopper 22 becomes depleted. Merchandising machine 10 may further provide a multiple vending function, where the consumer may be given the option to select a second item before being paid their change. This function may be selected by the operator or manager of the vending machine 10 and will then be automatically triggered by control 40, if the amount of credit remaining is sufficient to purchase at least one other item within the merchandising machine 10.

Preferably, even if the amount of money deposited into vending machine 10 is below the threshold level for the changing function, the consumer or user of vending machine 10 may still be able to request change for the amount of money deposited into the machine by selecting a change function on keypad 36. For example, if the consumer inserts a one or five-dollar bill into bill acceptor 31, the consumer may then input 0-0 as a selection item, which the control may interpret as a request for change and thus provide the user with an equivalent amount of change from bulk hopper unit 22. Although shown and described as having the user press 0-0 to get change for the money input into vending machine 10, clearly other codes may be entered into keypad 36, or a separate "change only" button or the like may be provided at or near keypad 36, to allow the user to select a change only function, without affecting the scope of the present invention. Therefore, if a change function is selected, the consumer would receive change from bulk hopper 22 in an amount equivalent to the money deposited into merchandising machine 10. On the other hand, if another code is entered into keypad 36 which corresponds to an item or a location of an item in the vending area 16 of vending machine 10, the consumer would receive the selected item, if enough credit was deposited in merchandising machine 10. If credit is deposited in excess of the purchase price of the selected item, the consumer may receive the selected item and also receive an appropriate amount of change from bulk hopper 22 and/or coin mechanism 44. However, if the amount deposited is not enough to purchase the selected item, merchandising machine 10 may provide a message to the consumer to deposit additional credit or may continue to display the amount deposited, as is known in the art.

When money is deposited into vending machine 10, bills that are inserted into the bill slot 30 are accepted and stored within bill acceptor 31, while coins that are inserted into coin slot 32 are received by coin acceptor 42 and deposited into the individual coin holding cylinders 44*a*, 44*b* and/or 44*c* of coin mechanism 44 or returned to the consumer. As the cylinders become full, the inserted coins are deposited into cash box 46 via coin chute 44*d*. If the supply of coins within one or more of the coin cylinders of coin mechanism becomes depleted, an "exact change only" light may be activated on vending machine 10, since the machine may no longer be able to provide exact change back to a purchaser of an item. However, because merchandising machine 10 further includes bulk hopper 22, the present invention may still function as a changing machine, since change may be provided to the user from the bulk hopper unit 22. In situations where the "exact change only" light or display is lit, the machine preferably may include instructions to let the customer know that change may still be available from the bulk hopper 22. The instructions may be in the form of a point of sale message which may be a scrolling message across the display 38, stating that the changing function is fully operable, or other messages or symbols. Such instructions communicate to the consumer that even though the "exact change only" light is on, the machine may still be operable as a bill changer, thereby reducing the chances of turning a potential customer away from the machine. This further allows the consumer to purchase the desired item with an amount of change, as provided from bulk hopper unit 22, which may be only slightly greater than the purchase price of the item. For example, if the exact change light or display is illuminated or otherwise activated, a user may not wish to deposit a one dollar bill (or greater) for a sixty-five cent item. However, the user may receive four quarters from bulk hopper 22 for the one dollar bill, and then may insert seventy-five cents into coin slot 32, thereby purchasing the sixty-five cent item for only ten cents more than the purchase price. By remaining operable as a changing machine even as coin mechanism 44 becomes empty, merchandising machine 10 remains operational as long as possible, thereby minimizing losses in sales due to depletion of coins within the coin cylinders which hold smaller denominations of coins, such as dimes and/or nickels.

Preferably, control 40 and the circuit board of bulk hopper unit 22 are operable to detect a low or empty condition of bulk hopper unit 22 via a detection circuit included in the bulk hopper unit. Accordingly, when a low coin threshold is reached, a signal may be provided to control 40, which may then provide a signal to consumers via display 38 or other lights or displays to communicate that the machine is no longer operable as a changing machine. This function substantially precludes the possibility that a customer would insert a ten or twenty dollar bill into bill slot 30 when there is not enough change in coin hopper 22 or coin mechanism 44 to provide change in that amount, thereby substantially precluding the possibility that the customer will be short-changed. The changing function of vending machine 10 would then be suspended until bulk hopper 22 is refilled and the low coin signal again indicates to control 40 that there are sufficient coins available in bulk hopper unit 22. During the time that the changing function is suspended, subsequent purchase transactions would use only the coin cylinders of coin mechanism 44 for making change. Preferably, merchandising machine 10 would only accept coins or lower denomination bills during the period of time in which the changing function is suspended.

Figure 4:
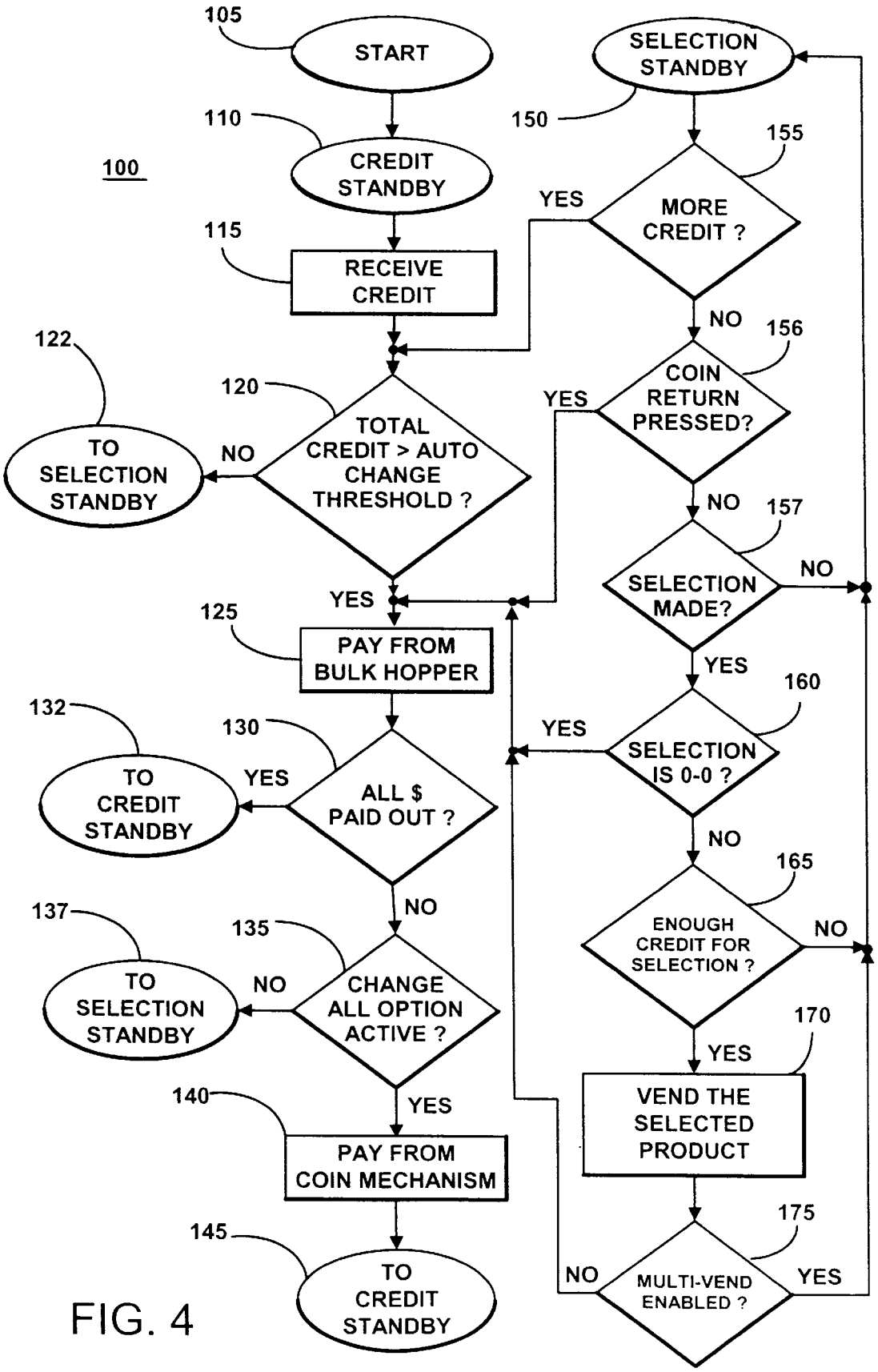
FIG. 4 is a flowchart of change and vending processes of a merchandising machine control useful with the present invention.

Referring now to FIG. 4, a vending and changing process 100 is shown which starts at 105. Prior to a user or consumer approaching vending machine 10, vending machine 10 is in a credit standby mode at 110 until vending machine 10 receives credit, such as bills, coins, tokens, and/or the like, from a customer at 115. Once credit is received at 115, control 40 determines at 120 whether the total credit is greater than an automatic change threshold. If it is determined at 120 that the total credit is not greater than the automatic change threshold, then the machine is operable at a selection standby mode at 122, where the machine waits for the consumer to enter a selection. The machine may prompt the user to enter a selection or may continue to display the amount deposited until a selection is made. If it is determined at 120 that the credit is greater than the automatic change threshold, then merchandising machine 10 pays the appropriate change to the user from bulk hopper 22 at 125. After money is paid from bulk hopper 22 at 125, it is determined at 130 whether all the money owed to the user has been paid out, since credit may remain which cannot be paid from bulk hopper 22. For example, if a ten cent credit remains, bulk hopper 22 cannot pay this amount if it contains only 25 cent coins. If it is determined at 130 that all the money has been paid out to the user by bulk hopper 22, then the machine returns to credit standby (110) at 132. If it is determined at 130 that all the money has not been paid out, then it is further determined at 135 whether a "change all" option is active. The "change all" function, which may be set on or off by the operator or manager of vending machine 10, is used to determine the disposition of any credit remaining after the bulk hopper 22 has delivered as many coins as possible without overpayment to the consumer. If the change all option is determined to be active at 135, then the remaining money owed to the user is paid from coin mechanism 44 at 140. The machine then returns to credit standby at 145. If it is determined at 135 that the change all option is not active, then the machine switches to selection standby mode at 137.

The selection standby mode begins at 150, where vending machine 10 waits for the consumer to make their selection, insert more money, or cancel the transaction and receive their money back. The insertion of money and cancel transaction functions have been discussed above. If it is determined that more credit has been received at 155, control continues to 120 to determine if the new total credit value exceeds the automatic change threshold as discussed above. If no additional credit has been received at 155, control continues at 156 to determine if the consumer has depressed the coin return lever 33 to cancel the transaction and receive their money back. If it is determined at 156 that the lever has been activated, control transfers to 125 to pay all existing credit to the consumer. If it is determined at 156 that the consumer has not depressed the lever, control passes to 157 to determine if the consumer has made a selection. The consumer may make the selection by entering the code using the keypad of the vending machine, as is known in the art. If it is determined at 157 that a selection has not been made, control resumes at the selection standby state, 150. If it is determined at 157 that a selection has been made, control proceeds to validate the selection at 160. After the selection is made, it is determined at 160 whether the selection is for change or for an item. If it is determined at 160 that the selection is 0-0 or otherwise a change selection, then the vending machine continues at 125 and proceeds to provide change to the consumer, as discussed above. If, on the other hand, it is determined at 160 that the selection is for an item, then it is further determined at 165 whether enough credit was deposited in the machine for the particular selection. If it is determined at 165 that there is not enough credit for the selection, then the machine returns to the selection standby mode at 150 and may display a message to the consumer requesting additional credit. However, if it is determined at 165 that there is enough credit for the particular selection, then the machine vends the selected product at 170. It is then determined at 175 whether a multi-vend function is enabled. The multi-vend function may be included in merchandising machine 10 to allow a consumer to select multiple items from the vending area before change is provided. This "multi-vend" function may be set on or off by the operator or manager of vending machine 10. This optional function avoids depleting coins from the bulk hopper and/or coin mechanism when the consumer has input enough money to purchase two or more items until the consumer has made all their desired purchases. If it is determined at 175 that the multi-vend function is enabled, the machine returns to the selection standby mode at 150. If it is determined at 175 that a multi-vend mode is not enabled, then the machine continues at 125 and proceeds to provide change to the user, as discussed above.

The bulk hopper unit 22 and control 40 of the present invention may be implemented with typical vending machines for vending snacks, whether refrigerated or non-refrigerated, beverages, or other, grocery or non-grocery items which may easily be displayed and dispensed from a merchandising machine. Because the bulk hopper unit 22 is included in the vending machine, the present invention may also sell relatively expensive items, such as, for example, books, audio or video tapes, CDs and/or the like, or other costly items, each of which may cost several dollars. These are typically items which are not provided by vending machines, since people do not typically carry such a large amount of change in their pocket. However, the present invention allows the consumer to insert a ten or twenty dollar bill to purchase a four, five, or six or more dollar item and still get the desired item and the appropriate amount of change in return. An additional application of the present invention is in other money, token or coin-operated machines, such as video arcade type games, casino gaming machines or the like, where a change function may be provided to the user in addition to the application of the money or tokens deposited into the machine for the purpose of utilizing the service provided, such as an interactive video game or casino game. This would allow the change function to be provided at the game itself, and thus not require a separate changing station.

Although described above as having a bulk hopper unit which may contain up to approximately 3,200 quarters, other quantities of other denominations of coins or tokens may be provided by bulk hopper 22. For example, the bulk hopper may provide dollar coins, nickels, game tokens, or the like, without affecting the scope of the present invention. Providing nickels in the hopper allows the vending machine to make exact change for all combinations of credit deposited and selections purchased and further allows the machine to do so for a relatively long period of time. However, it may not be desirable to provide change for ten or twenty dollar bills with only nickels, since not only would this be a potential annoyance to the consumer, but would also require an even larger coin return cup on vending machine 10. In an alternate embodiment, a second bulk loaded hopper unit (not shown) may also be provided within the space of the cabinet adjacent to the vending area. The second bulk hopper unit may be positioned generally above the first unit and have a second coin chute which extends downward to the coin return cup. By providing a second hopper unit, the first hopper unit may contain quarters, while the second unit may contain nickels. This allows the merchandising machine of the present invention to further delay activation of the "exact change only" light, while still being operable to provide change to a user in a desirable denomination. Preferably, the change function would be operable to provide dollar coins or quarters from the first bulk hopper unit, while change in excess of the purchase price of the selected product would be provided from the first bulk hopper unit and the second bulk hopper unit, and even from the coin mechanism as necessary. Furthermore, in the changing mode, the user may even be offered a choice as to what denomination of coin is to be returned. It is further envisioned that implementation of a second, and maybe even a third, bulk hopper containing nickels, and maybe also dimes, may obviate the need for a coin mechanism that has coin holding cylinders and means for dispensing the coins held therein.

Therefore, it can be seen that an advantage of the present invention is that the consumer can purchase high or low value items and receive change in a convenient form and/or can simply change bills of several denominations into coins for use in other vending machines, amusement devices and the like. However, the operator of the merchandising machine with bulk coin hopper 22 may find it inconvenient to properly reconcile the machine's product sales against the variety of actual cash held in the machine. In an alternate embodiment of the present invention, the change function is kept completely separate from the vending function. In such a system, a consumer would be able to insert large denomination bills and automatically receive change from bulk hopper 22, as described above. Also, the consumer could press a "make change" button or select item "0-0," as described earlier, to receive change only for smaller denomination bills. However, should the consumer select an item for purchase, change could be issued exclusively from the coin holding tubes in the coin mechanism. This keeps the bills changed as a separate entity from purchase transactions such that all of the coins get exchanged for that input of bills from the bulk hopper alone. Sales dollars may then be calculated for accounting purposes by totaling the remainder of the bills in the bill acceptor and the coins in the coin mechanism and cash box. This facilitates easier accounting processes over conventional vending machines, where both change transactions and purchase transactions dispense change from the coin mechanism, which mixes the change and purchase transactions together. However, it is preferred that change be provided first from the bulk hopper whenever possible, in order to avoid depletion of the coin supply in the coin mechanism for as long as possible.

Because the changing function may thus be kept separate from the purchase function, the accounting system for the changing mechanism of this alternate embodiment simply indicates the amount of money that was deposited into the machine for which change was either automatically provided or change was selected by the user. This amount of money, which may be recorded as an amount of bills inserted, such as ten five-dollar bills, fourteen ten-dollar bills, or the like, may easily be recorded to determine the amount of changing that the machine performed. This is a simplified accounting method, since the amount of money received is all that is necessary to record. The machine does not have to record the number of coins dispensed because the number of coins dispensed from bulk hopper 22 may be determined later by comparing the number of coins or tokens originally loaded into bulk hopper 22 with the number of any remaining coins or tokens in the bulk hopper 22 when the vending machine is later serviced.

Therefore, the present invention provides a coin dispensing device and control that is adaptable for use in a merchandising or vending machine, which provides a dual function as a product vending machine and as a bill changing machine. The merchandising machine of the present invention may function in a sales mode, where a user may deposit money or credits into the machine and select an item to be dispensed from the machine, or a changing mode, where the user may deposit money or credits into the machine and automatically or selectively receive change in an amount equivalent in value to the amount deposited into the machine. By incorporating a bulk loaded hopper into a merchandising machine, the merchandising machine of the present invention may remain operational for a longer period of time between servicing, since the amount of change available to be returned to the user is substantially greater than a conventional vending machine.

An additional benefit of the present invention is that the additional function of providing a changing mode allows the owner of a vending machine to avoid the purchase of an additional change machine for locations where it is desirable to have both machines present. For example, in a video arcade, laundromat or the like, it may be desirable to have both a change machine for providing tokens or quarters or other coins to the customers, and a vending machine to provide snacks or drinks or the like to the customers. The present invention provides both functions within the same unit, thereby avoiding the cost of two units and further avoiding the requirement of extra space at the arcade or laundromat to accommodate the two separate units. Because the bulk loaded hopper is included within an existing and generally vacant area of a conventional vending machine, such that the overall size of the vending machine is substantially equivalent to a conventional vending machine, extra space is not required to accommodate the dual function merchandising machine of the present invention.

The present invention is further operable as a changing machine even when the supply of coins in the coin mechanism has been depleted and the machine is operating in a "exact change only" mode. This allows the merchandising machine to still provide change to a user, who may then use the change to purchase a desired item, which substantially reduces the likelihood of turning away customers when the supply of coins in the coin mechanism has been substantially depleted. Additionally, because many individuals carry cash in denominations of ten or twenty-dollar bills, such as is generally the case after an individual receives cash from an ATM machine, the present invention allows such individuals to purchase a snack or other items from the vending machine, since the bill acceptor of the present invention is preferably capable of accepting large denomination bills, while still providing change in excess of the purchase price from the bulk hopper.

Changes and modifications in the specifically described embodiments can be carried out without departing from the principles of the invention, which is intended to be limited only by the scope of the appended claims, as interpreted accordingly to the principles of patent law.

The embodiments of the invention in which an exclusive property or privilege is claimed are defined as follows:

1. A merchandising machine operable to dispense selected items in response to a selection input, said merchandising machine comprising:

a cabinet for holding items available for dispensing;

a merchandise dispenser in said cabinet for dispensing an item selected by a user; and coin dispensing means for dispensing coins, said coin dispensing means including a bulk-loaded coin hopper in said cabinet.

2. The merchandising machine of claim 1, wherein said bulk-loaded coin hopper is operable to dispense coins in response to an input of credit being deposited in said merchandising machine.

3. The merchandising machine of claim 2, wherein said bulk-loaded coin hopper is operable to dispense change in an amount equal to an amount of money deposited in said merchandising machine in response to the money deposited being at least equal to an automatic change threshold.

4. The merchandising machine of claim 2, wherein said bulk-loaded coin hopper is operable to dispense change in an amount equal to an amount of money deposited in said merchandising machine in response to a change selection being made.

5. The merchandising machine of claim 2, wherein said bulk-loaded coin hopper dispenses change in an amount equal to an amount of money deposited less a purchase price of a selected item in response to an item selection being made.

6. The merchandising machine of claim 1, wherein said coin dispensing means further includes at least one coin holder, wherein said bulk-loaded coin hopper at least initially holds a substantially greater amount of coins than said at least one coin holder.

7. The merchandising machine of claim 6, wherein said at least one coin holder contains up to approximately 80 coins, said bulk-loaded coin hopper containing up to approximately 2,000 coins.

8. The merchandising machine of claim 1, wherein said bulk-loaded coin hopper contains up to approximately 2,000 coins.

9. The merchandising machine of claim 1, wherein said bulk-loaded coin hopper contains up to approximately 3,200 coins.

10. A merchandising machine for vending and dispensing items comprising:

a merchandising system which is operable to dispense selected items;

a control, said control determining an inserted amount deposited into the merchandising machine and further determining a return amount; and coin dispensing means comprising at least one container for holding a supply of coins in bulk, said coin dispensing means for dispensing a return amount out of said merchandising machine at least occasionally from said at least one container for holding a supply of coins in bulk in response to said control.

11. The merchandising machine of claim 10, wherein said coin dispensing means further includes at least one coin holder, wherein said container for holding a supply of coins in bulk is adapted to hold a substantially greater amount of coins than said at least one coin holder.

12. The merchandising machine of claim 10, wherein said return amount is at least one of change resulting from a sales function, which provides change of a value substantially equivalent to the inserted amount less a purchase price of a selected item, and change resulting from a change function, which provides change of a value substantially equivalent to the inserted amount.

13. The merchandising machine of claim 12, wherein said control circuit automatically switches from said sales function to said change function when the inserted amount reaches a predetermined threshold value.

14. The merchandising machine of claim 13, wherein said control is responsive to a user input to switch the merchandising machine to said change function irrespective of the inserted amount.

15. The merchandising machine of claim 13, wherein said control responds to a user input to switch the merchandising machine to said change function when the inserted amount is below said threshold value.

16. The merchandising machine of claim 13, wherein said threshold value is within a range of approximately five to ten dollars.

17. The merchandising machine of claim 16 further including a bill acceptor operable to receive dollar bills up to at least approximately a ten dollar denomination.

18. The merchandising machine of claim 13, wherein said threshold value is selectable by a manager of said merchandising machine.

19. The merchandising machine of claim 12, wherein said control responds to a user input to switch said merchandising machine between said sales function and said change function.

20. The merchandising machine of claim 10 further including a bill acceptor operable to accept up to a twenty dollar bill in a single transaction.

21. The merchandising machine of claim 10, wherein said coin dispensing means comprises a low coin detection system for determining when an amount of coins within said container for holding a supply of coins in bulk reduces to a low threshold level.

22. The merchandising machine of claim 21, wherein said control is operable to disable a change function, which provides change of a value substantially equivalent to the inserted amount, in response to the amount of coins within said container for holding a supply of coins in bulk reducing to the low threshold level.

23. The merchandising machine of claim 10, wherein said coin dispensing means includes a first container for holding a supply of a first denomination coin in bulk and a second container for holding a supply of a second denomination coin in bulk.

24. The merchandising machine of claim 23, wherein said first denomination coin is of a value greater than a value of said second denomination coin.

25. A merchandising machine for vending items in response to credit being deposited therein, said merchandising machine comprising:

a merchandise dispensing assembly for dispensing items selected by a user of said merchandising machine;

a credit receiving mechanism which receives credit therein and is operable to determine an input amount;

an arranged-coin dispenser comprising at least one storage container which stores an individual denomination of coin in an arranged fashion;

at least one bulk coin dispenser comprising a bulk storage bin adapted to store a single denomination of coin and a dispensing mechanism which is at least occasionally operable to dispense coins from said bulk storage bin out of said merchandising machine; and a control which responds to said credit receiving mechanism and selectively dispenses coins from at least one of said arranged-coin dispenser and said at least one bulk coin dispenser out of said merchandising machine.

26. The merchandising machine of claim 25, wherein said credit receiving mechanism comprises at least one of a bill acceptor and a coin receiving device.

27. The merchandising machine of claim 25, wherein said at least one bulk coin dispenser comprises two bulk coin dispensers.

28. The merchandising machine of claim 27, wherein each of said two bulk coin dispensers is adapted to store a different denomination of coin from the other of said two bulk coin dispensers.

29. The merchandising machine of claim 25, wherein said control is operable to dispense coins in an amount substantially equal to the credit received if the credit received is above an automatic change threshold.

30. The merchandising machine of claim 29, wherein said control is operable to dispense coins from said bulk coin dispenser in response to the credit received being above said automatic change threshold.

31. The merchandising machine of claim 30, wherein said control is further operable to dispense coins from said arranged-coin dispenser if a coin supply in said bulk coin dispenser is substantially depleted.

32. The merchandising machine of claim 25, wherein said control is operable to dispense coins in an amount substantially equal to the credit received in response to a change mode selection.

33. The merchandising machine of claim 32, wherein said control is operable to dispense coins from said bulk coin dispenser in response to the change mode selection.

34. The merchandising machine of claim 25, wherein said control is operable in at least one of a vend mode and a change mode in response to the credit received by said credit receiving device, said vend mode vending a selected item and providing change if the credit received is greater than a purchase price of the selected item, said change mode providing change in an amount substantially equal to the credit received.

35. The merchandising machine of claim 34, wherein said control is operable in said change mode in response to the credit received being greater than a change mode threshold.

36. The merchandising machine of claim 35, wherein said control is selectively operable in said change mode in response to a change selection being made by the user of said merchandising machine.

37. The merchandising machine of claim 34, wherein said control is selectively operable in said change mode in response to a change selection being made by the user of said merchandising machine.

38. The merchandising machine of claim 34, wherein said control further provides an accounting function, said accounting function being operable to separately track transactions made in said vend mode from transactions made in said change mode.

39. The merchandising machine of claim 25, wherein said at least one bulk coin dispenser is adapted to store up to at least approximately 2,000 coins.

40. The merchandising machine of claim 39, wherein one of said at least one storage container stores up to approximately 80 coins.

41. The merchandising machine of claim 25, wherein said arranged-coin dispenser comprises multiple storage containers, each storage container storing a different denomination of coin.

42. The merchandising machine of claim 25, wherein said control further provides an accounting function, said accounting function being operable to track transactions made.

43. A merchandising machine comprising:

a merchandising system operable to dispense a selected item;

a credit receiving mechanism operable to receive credit and determine an amount of credit being received;

a control operable to determine a return amount in response to the amount of credit received and any selection input to said merchandising machine, said control being further operable in at least one of a change mode to provide change of a value substantially equivalent to the credit received, and a vend mode, said merchandising system being operable to dispense the selected item when said control is in said vend mode; and at least one bulk coin dispenser adapted to store a single denomination coin and at least occasionally dispense said return amount out of said merchandising machine.

44. The merchandising machine of claim 43 further comprising a multiple-denomination coin dispenser comprising a plurality of coin storage containers which each store a different denomination of coin from the other of said plurality of coin dispensers.

45. The merchandising machine of claim 43, wherein said merchandising machine is an item vending machine, said merchandising system being operable to dispense selected items in response to said control when control is operable in said vend mode.

46. The merchandising machine of claim 45, wherein said merchandising system is operable to dispense at least one of refrigerated foods, non-refrigerated foods, snacks, beverages, and non-grocery items.

47. The merchandising machine of claim 43, wherein said control is automatically switchable between said vend mode and said change mode in response to the amount of credit received.

48. The merchandising machine of claim 47, wherein said control is selectively switchable between said vend mode and said change mode in response to a selection by a user of said merchandising machine.

49. The merchandising machine of claim 43, wherein said control is selectively switchable between said vend mode and said change mode in response to a selection by a user of said merchandising machine.

50. The merchandising machine of claim 43, wherein said at least one bulk coin dispenser is adapted to store up to at least approximately 2,000 coins.

51. The merchandising machine of claim 43, wherein said at least one bulk coin dispenser is adapted to store up to at least approximately 3,200 coins.

52. A bulk coin dispensing unit adapted for use within the cabinet of a merchandising machine which is operable to vend items in response to credit being deposited therein, the merchandising machine including a cabinet, a merchandise dispensing assembly for dispensing items selected by a user, an arranged coin dispenser with at least one storage container which stores an individual denomination of coins in an arranged fashion, and a credit receiving mechanism which receives credit therein and is operable to determine an input amount, said bulk coin dispensing unit comprising:

at least one bulk coin dispenser having a bulk storage bin adapted to store a single denomination of coin and a dispensing mechanism which is operable to dispense coins from said bulk storage bin; and a control which is connectable to the merchandising machine and is operable to respond to the credit receiving mechanism of the merchandising machine and to selectively dispense coins from at least one of the arranged coin dispenser and said at least one bulk coin dispenser out of the merchandising machine.

53. The bulk coin dispensing unit of claim 52, wherein said at least one bulk coin dispenser comprises two bulk coin dispensers.

54. The bulk coin dispensing unit of claim 53, wherein each of said two bulk coin dispensers is adapted to store a different denomination of coin from the other of said two bulk coin dispensers.

55. The bulk coin dispensing unit of claim 52, wherein said control is operable to dispense coins in an amount substantially equal to the input amount if the input amount is above an automatic change threshold.

56. The bulk coin dispensing unit of claim 55, wherein said control is operable to dispense coins from said bulk coin dispenser in response to the input amount being above said automatic change threshold.

57. The bulk coin dispensing unit of claim 56, wherein said control is further operable to cause the arranged coin dispenser of the merchandising machine to dispense coins if a coin supply in said bulk coin dispenser is substantially depleted.

58. The bulk coin dispensing unit of claim 52, wherein said control is operable in at least one of a vend mode and a change mode to provide change of a value substantially equivalent to the credit input.

59. The bulk coin dispensing unit of claim 58, wherein said control is operable in said at least one of said vend mode and said change mode in response to credit received by the credit receiving mechanism of the merchandising machine.

60. The bulk coin dispensing unit of claim 58, wherein said control is operable in said at least one of said vend mode and said change mode in response to a selection by a user of the merchandising machine.

61. The bulk coin dispensing unit of claim 58, wherein said control is operable to provide an accounting function which is operable to separately track transactions made in said vend mode from transactions made in said change mode.

62. The bulk coin dispensing unit of claim 52, wherein said at least one bulk coin dispenser is adapted to store up to at least approximately 2,000 coins.

63. A method of modifying a merchandising machine comprising the steps of:

providing a merchandising machine which is operable to vend items in response to credit being deposited therein, the merchandising machine including a cabinet, a merchandise dispensing assembly for dispensing items selected by a user, and a credit receiving mechanism which receives credit therein and is operable to determine an input amount;

providing a bulk coin dispensing unit which includes a bulk storage bin adapted to store a single denomination of coin and a dispensing mechanism which is operable to dispense coins from said bulk storage bin;

mounting said bulk coin dispensing unit within the cabinet of the merchandising machine; and connecting a control to the merchandising machine and to said bulk coin dispensing unit, said control being operable to respond to the credit receiving mechanism of the merchandising machine and to selectively dispense coins from said at least one bulk coin dispensing unit out of the merchandising machine.

64. The method of claim 63, wherein the merchandising machine includes an arranged coin dispenser with at least one storage container which stores an individual denomination of coins in an arranged fashion, said control being operable to selectively dispense coins from the arranged coin dispenser and said at least one bulk coin dispensing unit.

65. The method of claim 63, wherein the step of mounting said bulk coin dispensing unit includes removably mounting said bulk storage bin within the cabinet.

66. The method of claim 65, wherein the step of mounting said bulk coin dispensing unit includes pivotally mounting said bulk storage bin within the cabinet.

67. The method of claim 63, wherein the step of mounting said bulk coin dispensing unit includes pivotally mounting said bulk storage bin within the cabinet.

68. The method of claim 63, wherein the step of mounting said bulk coin dispensing unit includes connecting a chute between said dispensing mechanism of said bulk coin dispensing unit and a coin return holder of the merchandising machine.

69. The method of claim 63, wherein the merchandising machine includes a control panel, the step of mounting said bulk coin dispensing unit includes positioning said bulk storage bin in a space adjacent the control panel.

70. The method of claim 63, wherein the storage container of the merchandising machine is adapted to store up to approximately 80 coins.

71. The method of claim 63, wherein said bulk storage bin is adapted to store up to at least approximately 2000 coins.

72. A merchandising machine comprising:

a merchandise dispensing system for dispensing selected items;

a credit receiving device which is operable to receive credit and to determine an amount of credit being received thereby; and a bulk-loaded coin hopper operable to at least occasionally dispense change of a value substantially equal to an amount of credit received by said credit receiving device less a purchase price of a selected item and to at least occasionally dispense change of a value substantially equal to an amount of credit received by the credit receiving device.

73. The merchandising machine of claim 72, wherein said bulk-loaded coin hopper adapted to hold up to approximately 2000 coins.

74. The merchandising machine of claim 72 further comprising a multiple-denomination coin dispenser comprising a plurality of coin storage containers which each store a different denomination of coin from the other of said plurality of coin dispensers.

75. The merchandising machine of claim 72, wherein said bulk-coin hopper is selectively operable between a vend mode, wherein the change dispensed is equal to the amount of credit received by said credit receiving device less the purchase price of a user selection, and a change mode, wherein the change dispensed is substantially equivalent to the amount of credit received by said credit receiving device.

76. The merchandising machine of claim 75, wherein said bulk-coin hopper is selectively operable in response to a user input at said merchandising machine.

77. The merchandising machine of claim 72, wherein said bulk-coin hopper is automatically switchable between a vend mode, wherein the change dispensed is substantially equivalent to the amount of credit received by said credit receiving device less the purchase price of a user selection, and a change mode, wherein the change dispensed is substantially equivalent to the amount of credit received by said credit receiving device, in response to the amount of credit being received by said credit receiving device.

78. The merchandising machine of claim 77, wherein said bulk-coin hopper is automatically operable in said change mode in response to the credit received being greater than a threshold amount.

79. The merchandising machine of claim 72, wherein the change is at least occasionally an amount substantially equivalent to the amount of credit received by said credit receiving device.

80. The merchandising machine of claim 79, wherein said bulk-coin hopper is automatically operable to dispense change in an amount substantially equivalent to the amount of credit received by said credit receiving device in response to the credit received being greater than a threshold amount.

81. A merchandising machine comprising:

a merchandise dispensing system for dispensing selected items;

a credit receiving device which is operable to receive credit and to determine an amount of credit being received thereby; and a bulk-loaded coin hopper, said bulk-loaded coin hopper being operable to at least occasionally dispense change in an amount substantially equivalent to the amount of credit received by said credit receiving device less a purchase price of a selected item.

82. The merchandising machine of claim 81, wherein said bulk-coin hopper is adapted to contain up to approximately 2000 coins.

83. The merchandising machine of claim 81, wherein the change is at least occasionally an amount substantially equivalent to the amount of credit received by said credit receiving device.

84. The merchandising machine of claim 81, wherein said bulk-coin hopper is selectively operable between a vend mode, wherein the change dispensed is substantially equivalent to the amount of credit received by said credit receiving device less the purchase price of a user selection, and a change mode, wherein the change dispensed is substantially equivalent to the amount of credit received by said credit receiving device.

85. The merchandising machine of claim 84, wherein said bulk-coin hopper is selectively operable in response to a user input at said merchandising machine.

86. The merchandising machine of claim 81, wherein said bulk-coin hopper is automatically switchable between a vend mode, wherein the change dispensed is substantially equivalent to the amount of credit received by said credit receiving device less the purchase price of a user selection, and a change mode, wherein the change dispensed is substantially equivalent to the amount of credit received by said credit receiving device, in response to the amount of credit being received by said credit receiving device.

87. The merchandising machine of claim 86, wherein said bulk-coin hopper is automatically operable in said change mode in response to the credit received being greater than a threshold amount.

88. The merchandising machine of claim 81, wherein said bulk-coin hopper is automatically operable to dispense change in an amount substantially equivalent to the amount of credit received by said credit receiving device in response to the credit received being greater than a threshold amount.

89. A merchandising machine comprising:

a merchandise dispensing system;

a credit receiving device which is operable to receive credit and to determine an amount of credit being received thereby; and a bulk-loaded coin hopper, said bulk-loaded coin hopper being selectively operable to at least occasionally automatically dispense change in an amount substantially equivalent to the amount of credit received by said credit receiving device, the change being dispensed to a user of said merchandising machine.

90. The merchandising machine of claim 89, wherein said bulk-loaded coin hopper is operable to automatically dispense change in an amount substantially equivalent to the amount of credit received by said credit receiving device in response to the credit received being greater than a threshold amount.

91. The merchandising machine of claim 89, wherein said bulk-coin hopper is operable to dispense change substantially equivalent to the amount of credit received by said credit receiving device irrespective of the amount of credit received in response to a user input at said merchandising machine.

92. The merchandising machine of claim 89, wherein the change being dispensed is at least occasionally an amount substantially equivalent to an amount of credit received by said credit receiving device less a purchase price of a user selection.

93. The merchandising machine of claim 89, wherein said bulk-coin hopper is selectively operable between a vend mode, wherein the change dispensed is substantially equivalent to the amount of credit received by said credit receiving device less the purchase price of a user selection, and a change mode, wherein the change dispensed is substantially equivalent to the amount of credit received by said credit receiving device.

94. The merchandising machine of claim 89, wherein said bulk-coin hopper is selectively operable in response to a user input at said merchandising machine.

95. The merchandising machine of claim 89, wherein said bulk-coin hopper is selectively operable in response to the amount of credit being received by said credit receiving device.

96. The merchandising machine of claim 89, wherein said bulk-coin hopper is automatically switchable between a vend mode, wherein the change dispensed is substantially equivalent to the amount of credit received by said credit receiving device less the purchase price of a user selection, and a change mode, wherein the change dispensed is substantially equivalent to the amount of credit received by said credit receiving device, in response to the amount of credit being received by said credit receiving device.

97. The merchandising machine of claim 89, wherein said bulk-coin hopper is adapted to contain up to approximately 2000 coins.

98. A merchandising machine comprising:

a merchandise dispensing system;

a credit receiving device which is operable to receive credit and to determine an amount of credit being received thereby;

an accounting control which is operable to track transactions made at said merchandising machine; and a bulk-loaded coin hopper, said bulk-loaded coin hopper being operable to at least occasionally dispense change in response to at least one of said credit receiving device and a user input.

99. The merchandising machine of claim 98, wherein the change being dispensed is at least occasionally an amount substantially equivalent to an amount of credit received by said credit receiving device less a purchase price of a user selection.

100. The merchandising machine of claim 98, wherein the change is at least occasionally an amount substantially equivalent to the amount of credit received by said credit receiving device.

101. The merchandising machine of claim 100, wherein said bulk-coin hopper is automatically operable to dispense change in an amount substantially equivalent to the amount of credit received by said credit receiving device in response to the credit received being greater than a threshold amount.

102. The merchandising machine of claim 98, wherein said bulk-coin hopper is selectively operable between a vend mode, wherein the change dispensed is substantially equivalent to the amount of credit received by said credit receiving device less the purchase price of a user selection, and a change mode, wherein the change dispensed is substantially equivalent to the amount of credit received by said credit receiving device.

103. The merchandising machine of claim 102, wherein said bulk-coin hopper is selectively operable in response to a user input at said merchandising machine.

104. The merchandising machine of claim 102, wherein said bulk-coin hopper is selectively operable in response to the amount of credit being received by said credit receiving device.

105. The merchandising machine of claim 98, wherein said bulk-coin hopper is adapted to contain up to approximately 2000 coins.

106. A merchandising machine operable to dispense selected items in response to a selection input, said merchandising machine comprising:

a cabinet for holding items available for dispensing;

a merchandise dispenser in said cabinet for dispensing an item selected by a user; p1 a first coin holder and dispenser in said cabinet, said first coin holder and dispenser comprising a bulk-loaded coin hopper and being at least occasionally operable to dispense change out of said merchandising machine; and a second coin holder and dispenser in said cabinet, said second coin holder and dispenser being at least occasionally operable to dispense change out of said merchandising machine.

107. The merchandising machine of claim 106, wherein said second coin holder and dispenser comprises a bulk-loaded coin hopper, said second coin holder and dispenser holding and dispensing a different denomination of coin from said first coin holder and dispenser.

108. The merchandising machine of claim 106, wherein said second coin holder and dispenser comprises an arranged coin dispenser with at least one storage container which stores an individual denomination of coins in an arranged fashion.

109. The merchandising machine of claim 108, wherein said second coin holder and dispenser is operable to at least occasionally dispense change in an amount substantially equivalent to an amount input into said merchandising machine.

110. The merchandising machine of claim 109, wherein said first coin holder and dispenser is operable to at least occasionally dispense change having a value substantially equivalent to at least one of an amount of credit being input into said merchandising machine and an amount of credit being input less a purchase price of the selected item.

111. The merchandising machine of claim 106, wherein said first coin holder and dispenser is operable to at least occasionally dispense change having a value substantially equivalent to at least one of an amount of credit being input into said merchandising machine and an amount of credit being input less a purchase price of the selected item.

* * * * *